US010202763B2

(12) United States Patent
Hogan et al.

(10) Patent No.: US 10,202,763 B2
(45) Date of Patent: Feb. 12, 2019

(54) PERIMETER WALL

(71) Applicant: Cupples International Inc., Eagan, MN (US)

(72) Inventors: Jerry Clyde Hogan, Pelham, AL (US); Michel Francois Michno, Minneapolis, MN (US)

(73) Assignee: CUPPLES INTERNATIONAL, INC., Eagan, MN (US)

( * ) Notice: Subject to any disclaimer, the term of this patent is extended or adjusted under 35 U.S.C. 154(b) by 0 days.

(21) Appl. No.: 15/629,156

(22) Filed: Jun. 21, 2017

(65) Prior Publication Data

US 2017/0350117 A1 Dec. 7, 2017

Related U.S. Application Data

(63) Continuation of application No. 14/535,168, filed on Nov. 6, 2014.

(Continued)

(51) Int. Cl.
*E04B 2/90* (2006.01)
*E04B 2/88* (2006.01)

(Continued)

(52) U.S. Cl.
CPC ..... *E04B 2/965* (2013.01); *E04B 1/36* (2013.01); *E04B 1/40* (2013.01); *E04B 2/885* (2013.01);

(Continued)

(58) Field of Classification Search
CPC ... E04B 2/88; E04B 2/885; E04B 2/90; E04B 2/92; E04B 2/96; E04D 2001/34;

(Continued)

(56) References Cited

U.S. PATENT DOCUMENTS 2,914,145 A 11/1959 Benson
3,052,330 A 9/1962 Hammitt et al.

(Continued)

FOREIGN PATENT DOCUMENTS

EP 0586320 A1 3/1994
EP 0444552 B1 12/1995

OTHER PUBLICATIONS

"Curtain Wall Design Guide Manual," American Architectural Manufacturers Association, AAMA CW-DG-1-96, May 2005, 50 pp.

(Continued)

*Primary Examiner* — Phi D A
(74) *Attorney, Agent, or Firm* — Shumaker & Sieffert, P.A.

(57) ABSTRACT

An outer covering of a building includes anchor bolts configured to extend outwardly from an exterior side of floor support structures of the building, a plurality of anchor plates that adjustably mount to the plurality of anchor bolts, and a plurality of spandrel units that mount to an exterior side of the plurality of anchor plates. Each of the plurality of spandrel units includes a first mounting structure that receives a first outer covering section from above and supports a dead weight and lateral load of the first outer covering section via a corresponding one of the plurality of anchor plates and associated anchor bolts, and a second mounting structure configured to rotationally receive a second outer covering section after dead weight of the second outer covering section is loaded on an adjacent spandrel unit located below that one of the plurality of spandrel units.

20 Claims, 16 Drawing Sheets

Related U.S. Application Data

(60) Provisional application No. 61/901,745, filed on Nov. 8, 2013.

(51) Int. Cl.

| | |
|---|---|
| ***E04B 2/96*** | (2006.01) |
| ***E04B 1/36*** | (2006.01) |
| ***E04B 1/41*** | (2006.01) |
| ***E04B 2/00*** | (2006.01) |
| ***E06B 1/18*** | (2006.01) |
| ***E06B 3/54*** | (2006.01) |

(52) U.S. Cl.
CPC ..... *E04B 2/90* (2013.01); *E04C 2/46* (2013.01); *E06B 1/18* (2013.01); *E06B 3/5427* (2013.01); *E04B 2103/02* (2013.01); *E04B 2103/04* (2013.01); *E04B 2103/06* (2013.01)

(58) Field of Classification Search
CPC .... E04D 2001/3438; E04D 2001/3455; E04D 2001/3414
See application file for complete search history.

(56) References Cited

U.S. PATENT DOCUMENTS

| | | | | | |
|---|---|---|---|---|---|
| 3,203,151 | A | | 8/1965 | Bransford, Jr. | |
| 3,206,901 | A | | 9/1965 | Bakke | |
| 3,936,986 | A | | 2/1976 | Steel | |
| 3,968,608 | A | | 7/1976 | Swango | |
| 4,070,806 | A | | 1/1978 | Hubbard | |
| 4,473,984 | A | | 10/1984 | Lopez | |
| 4,543,755 | A | | 10/1985 | Crandell | |
| 4,561,228 | A | * | 12/1985 | Kaminaga | E04B 2/96 52/204.591 |
| 4,565,040 | A | | 1/1986 | Kaminaga | |
| 4,633,631 | A | | 1/1987 | Crandell | |
| 4,712,345 | A | | 12/1987 | Kaminaga | |
| 4,738,065 | A | | 4/1988 | Crandell | |
| 5,063,718 | A | | 11/1991 | Nonis | |
| 5,127,202 | A | | 7/1992 | Yokota et al. | |
| 5,158,392 | A | * | 10/1992 | Takeda | E04B 2/34 403/315 |
| 5,197,255 | A | | 3/1993 | Fricker | |
| 5,243,805 | A | | 9/1993 | Fricker | |
| 5,267,419 | A | | 12/1993 | Yokota et al. | |
| 5,323,577 | A | * | 6/1994 | Whitmyer | E04B 2/96 52/209 |
| 5,481,839 | A | | 1/1996 | Lang et al. | |
| 6,360,498 | B1 | | 3/2002 | Westphal | |
| 6,591,562 | B2 | | 7/2003 | Ting | |
| 6,658,804 | B2 | * | 12/2003 | Leytes | E04B 2/885 52/1 |
| 6,715,248 | B2 | | 4/2004 | Biebuyck | |
| 7,681,366 | B2 | | 3/2010 | De Gobbi | |
| 8,413,403 | B2 | | 4/2013 | Walker, III et al. | |
| 8,555,577 | B2 | * | 10/2013 | Maday | E04B 2/00 52/235 |
| 9,200,444 | B2 | | 12/2015 | Ra | |
| 2004/0099778 | A1 | | 5/2004 | Hogan | |
| 2004/0168382 | A1 | | 9/2004 | Rudduck et al. | |
| 2007/0022682 | A1 | * | 2/2007 | Morgenegg | E04B 2/90 52/235 |
| 2007/0039258 | A1 | | 2/2007 | Walker, III | |
| 2012/0210658 | A1 | | 8/2012 | Logan | |

OTHER PUBLICATIONS

"Curtain wall," Definition—Wikipedia, the free encyclopedia, retrieved from http://en.wikipedia.org/w/index.php?title=Curtain_wall&oldid=579394929, Oct. 30, 2013, 11 pp.

"Curtainwall, Products, Performance and Practicality," WAUSAU, Window and Wall Systems, A Wausau AIA-CES Presentaiton, 2010, 49 pp. (Applicant points out that, in accordance with MPEP 609.04(a), the 2010 year of publication is sufficiently earlier than the effective U.S. filing date and any foreign priority date of Nov. 6, 2014 so that the particular month of publication is not in issue.).

"Disputes in Construction, Construction Defects Expert, Curtain Wall, Window Wall," The Holloway Consulting Group, LLC, 2013, 9 pp. (Applicant points out that, in accordance with MPEP 609.04(a), the 2013 year of publication is sufficiently earlier than the effective U.S. filing date and any foreign priority date of Nov. 6, 2014 so that the particular month of publication is not in issue.).

"Windows—Curtain Wall vs. As-Built Condition," Disputes in Construction, The Holloway Consulting Group, LLC, 2013, 1 pp. (Applicant points out that, in accordance with MPEP 609.04(a), the 2013 year of publication is sufficiently earlier than the effective U.S. filing date and any foreign priority date of Nov. 6, 2014 so that the particular month of publication is not in issue.).

Office Action from counterpart Canadian Application No. 2,870,259 dated Jan. 21, 2016, 4pp.

Response to Official Action dated Jan. 21, 2016, from counterpart Canadian Application No. 2,870,259, filed on Jul. 20, 2016, 24 pp.

Office Action from counterpart Canadian Application No. 2,870,259 dated Dec. 1, 2016, 3 pp.

Prosecution History from U.S. Appl. No. 14/535,168, dated Jan. 28, 2015 through May 22, 2017, 109 pp.

Request for Reinstatement and Response to Official Action dated Dec. 1, 2017 from counterpart Canadian Application No. 2,870,259, filed Jun. 1, 2018, 19 pp.

Notice of Allowance from counterpart Canadian Application No. 2,870,259, dated Jul. 4, 2018, 2 pp.

* cited by examiner 21
30
30
2
20
24
24
35
35
20
10
22
18
22
40

20
44

40
42

12
10
14
16
18
18

400
10
24
22
35
400

400

400

PERIMETER WALL

This application is a continuation of U.S. application Ser. No. 14/535,168, filed on Nov. 6, 2014, which claims the benefit of U.S. Provisional Application No. 61/901,745, filed Nov. 8, 2013, both of which are incorporated by reference herein.

TECHNICAL FIELD

The invention relates to walls of a structure, and more particularly, but not limited to external walls of a building.

BACKGROUND

A window wall typically includes outer coverings of a building installed between floor support structures in a multi-story building. A window wall is subjected to various loads such as its own weight and wind loads. Generally, the loads of each story of a window wall are transferred to the top of floor support structure immediately under that story of the window wall and to the bottom of the floor support structure immediately above that story of the window wall.

In contrast, a curtainwall includes outer coverings of a building installed outside the perimeter of the floor support structures in a multi-story building. Curtainwalls do not provide load bearing for the building structure. The loads imposed on a curtainwall are transferred to anchor points attached to other support structures of the building, such as one or more of the floor support structures and/or vertical columns of the building structure. In some examples, the loads imposed on the glazing of the curtainwall pass through vertical mullions of the curtainwall to the anchor points, often located at the top of the curtainwall elements, on the building structure.

SUMMARY

This disclosure relates to an alternative design for outer coverings of a building, referred to herein as a perimeter wall or more generically as a perimeter wall. The disclosed perimeter wall techniques may include anchor plates made of extruded aluminum, steel or other materials mounted to the exterior side of floor support structures of a building via adjustable anchors, such as bolts. A frame member of the perimeter wall may mount to the top of the anchor plate, which runs generally horizontal along the exterior side of the floor support structure and supports the dead load of the perimeter wall via the adjustable anchors. The bottom of the same anchor plate also serves to constrain the top of the perimeter wall of the floor below. In this manner, a single anchor plate may provide mounting fixtures for the top of one portion of the perimeter wall and the bottom of the adjacent portion of the perimeter wall. In addition, example perimeter walls disclosed herein may be mounted outside the perimeter of the floor support structures in a multi-story building.

In one example, this disclosure is directed to a kit for an outer covering of a building comprises a plurality of anchor bolts configured to be installed to extend outwardly from an exterior side of floor support structures of the building, a plurality of anchor plates configured to be adjustably mounted to the plurality of anchor bolts on the exterior sides of the floor support structures of the building, and a plurality of spandrel units. The plurality of spandrel units are configured to mount to an exterior side of the plurality of anchor plates. Each of the plurality of spandrel units includes a first mounting structure configured to receive a first outer covering section of a plurality of outer covering sections from above and to support a dead weight and lateral load of the first outer covering section via a corresponding one of the plurality of anchor plates and associated anchor bolts, and a second mounting structure configured to rotationally receive a second outer covering section of the plurality of outer covering sections after dead weight of the second outer covering section is loaded on an adjacent spandrel unit located below that one of the plurality of spandrel units.

In another example, this disclosure is directed to an assembly for an outer covering of a building comprising a plurality of anchor bolts installed to extend outwardly from an exterior side of floor support structures of the building, a plurality of anchor plates adjustably mounted to the plurality of anchor bolts on the exterior sides of the floor support structures of the building, a plurality of outer covering sections including: frame members mounted between two of the plurality of anchor plates, the two of the plurality of anchor plates being installed on two separate floor support structures of the building, and outer covering material spanning spaces between the frame members, a plurality of spandrel units, the plurality of spandrel units mounted to an exterior side of the plurality of anchor plates. Each of the plurality of spandrel units includes a first mounting structure that receives a first outer covering section of the plurality of outer covering sections from above and to support a dead weight and lateral load of the first outer covering section via a corresponding one of the plurality of anchor plates and associated anchor bolts, and a second mounting structure that rotationally receives a second outer covering section of the plurality of outer covering sections after dead weight of the second outer covering section is loaded on an adjacent spandrel unit located below that one of the plurality of spandrel units. The plurality of outer covering sections are located outside the perimeter of the floor support structures supporting the two of the plurality of anchor plates.

In a further example, this disclosure is directed to a method of installing an outer covering of a building comprising installing a plurality of anchor bolts to extend outwardly from an exterior side of floor support structures of the building, mounting a plurality of anchor plates to the plurality of anchor bolts on the exterior sides of the floor support structures of the building, and installing a plurality of outer covering sections to the plurality of anchor plates such that each of the plurality of outer covering sections is located between two of the plurality of anchor plates, the two of the plurality of anchor plates being installed on two separate floor support structures of the building. The plurality of outer covering sections each include: frame members configured to be mounted between the two of the plurality of anchor plates, and outer covering material spanning spaces between the frame members. The bottom one of the two of the plurality of anchor plates supports a dead weight of the outer covering sections once the outer covering sections are installed to the plurality of anchor plates. The plurality of outer covering sections are located outside the perimeter of the floor support structures supporting the two of the plurality of anchor plates once the outer covering sections are installed to the plurality of anchor plates.

The details of one or more examples of the disclosure are set forth in the accompanying drawings and the description below. Other features, objects, and advantages of this disclosure will be apparent from the description and drawings, and from the claims.

BRIEF DESCRIPTION OF DRAWINGS

FIGS. 1A-8 illustrate components and an example installation procedure of a perimeter wall in accordance with one example of this disclosure.

FIGS. 14A-20B illustrate components and an example installation procedure of a perimeter wall in accordance with one example of this disclosure.

DETAILED DESCRIPTION

Figures 1A, 1B, 2A, 2B, 3:
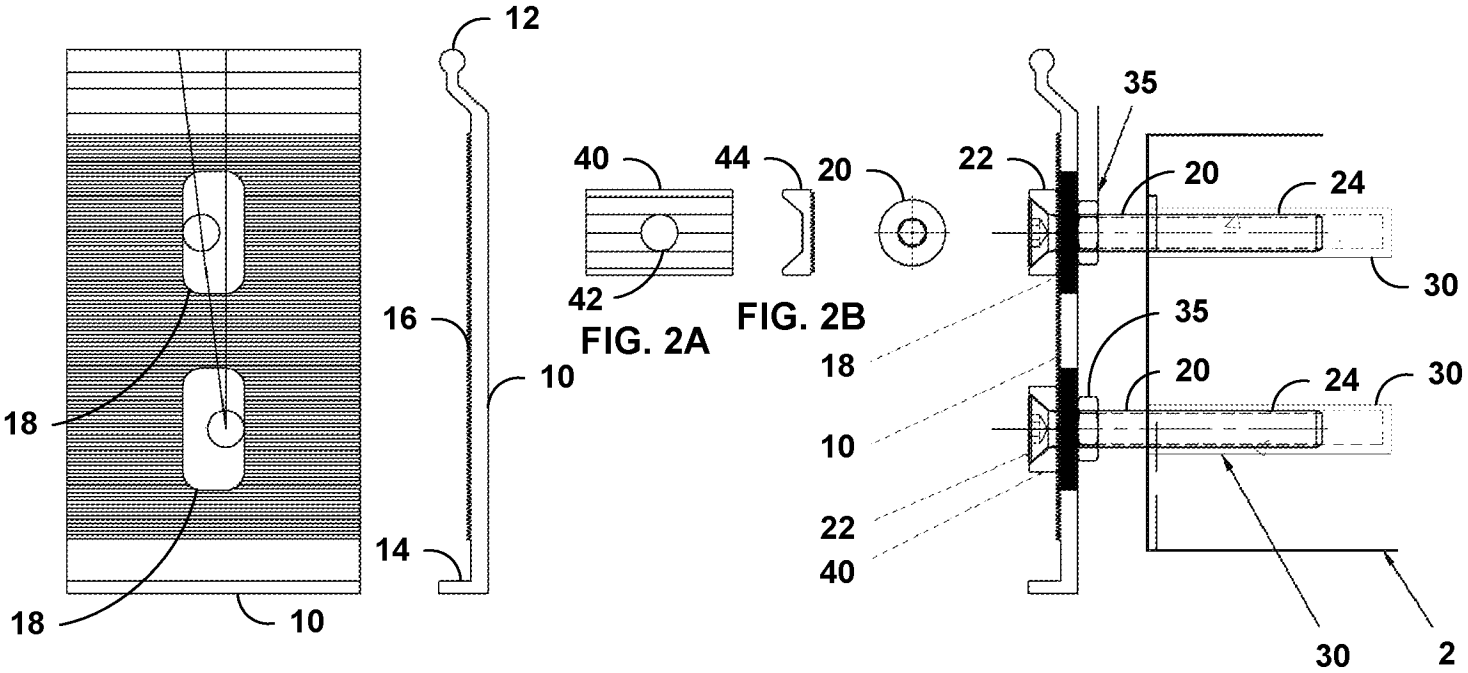

A perimeter wall, according to the techniques of this disclosure, may include anchor plates mounted to the exterior side of floor support structures of the building via adjustable anchors, such as bolts. A floor unit, such as a spandrel unit or other type of slab cover unit, of the perimeter wall may mount to the top and bottom of the anchor plate. Floor units may generally run horizontal along the exterior side of floor support structure. The dead load of the floor units may be supported by the adjustable anchors. The top of the floor unit may support, via the anchor plate, the dead load of an infill unit, also referred in this disclosure as a wall unit or a vision unit. In other words, a floor unit may be configured to transfer the load of an infill unit to the anchor plate. The bottom of the same anchor plate also serves to constrain the top of the infill unit of the floor below. In this manner, a single anchor plate may support a floor unit and provide mounting fixtures for the top of one infill unit and the bottom of another infill unit. Once installed, the combination of floor units and infill units (e.g. the combination of spandrel units and vision units) may produce an exterior appearance that looks like that of a traditional curtain wall. As will be explained below, however, alternative looks may also be achieved using the techniques of this disclosure, including looks that more closely resemble a traditional window wall.

The anchor plates may be mounted in a cantilevered fashion to the exterior side of floor support structures in that adjustable anchors are only supported on one side, and the anchor plates may not mount flush with the exterior side of floor support structures or may not even contact the exterior side of floor support structures. In some examples, the adjustable anchors may provide six degree of freedom adjustability for the anchor plates by allowing each anchor bolt to be extended or retracted relative to the floor support structure of the building as well as allowing positional adjustment of the anchor bolts within oversize holes of the anchor plates. The oversize holes of the anchor plates may further facilitate installation of the anchor plates even if the anchor bolts are misaligned relative to each other as installed within the floor support structures of the building.

Perimeter walls as disclosed herein may be mounted outside the perimeter of the floor support structures in a multi-story building, like a curtainwall. However, like a window wall, dead load of each segment of a perimeter wall is supported by the floor support structure below the perimeter wall. The perimeter wall of this disclosure may provide a variety of advantages as compared to either a standard window wall or a standard curtainwall. The anchor plate design allows spandrel units to be mounted outside the building structure but can also allow an offset between spandrel units and vision units, in or out or at a variable dimension (see e.g. FIG. 19).

As one example, the perimeter wall may provide simplified installation and reduced costs as compared to a typical curtainwall. For example, the perimeter wall may be assembled using pre-assembled outer covering sections of relatively low cost. In addition, the covering sections may be installed from the interior of the building in no particular order among adjacent floors, thereby providing for a simplified installation procedure and efficient use of field labor.

As another example, a perimeter wall may include a plurality of horizontal rows of floor units and infill units, such that the completed perimeter wall may provide better sound attenuation between floors than a traditional curtainwall.

As a further example, the design of the segments of a perimeter wall may provide for interruption of mullions providing vertical seams between the segments of the perimeter wall at top and bottom of each horizontal row of spandrel units. This may reduce or eliminate the chimney affect for fire or odors often present in traditional curtainwall mullions.

The perimeter wall may also provide spandrel units mounted to an exterior side of the floor support structure, limiting or potentially eliminating the need to provide waterproofing for the floor support structure itself. In addition, because the exterior side of the floor support structure may be covered by the spandrel units, the completed perimeter wall may provide the appearance of a curtainwall. Further, the disclosed designs also allow for the installation of the spandrel units to occur prior to the installation of the segments of the perimeter wall, which further facilitates efficient use of field labor.

These and other advantages may be provided by the specific examples of perimeter walls discussed in detail below.

FIGS. 1A-8 illustrate components of, and an example installation procedure for, a perimeter wall in accordance with one example of this disclosure. Sheet 1A includes FIGS. 1A-3. In particular, FIGS. 1A-1B illustrate anchor plate 10, FIGS. 2A-2B illustrate serrated nut bars 40, and FIG. 3 illustrates anchor plate 10 mounted to floor support structure 2 with anchor bolts 20 and serrated nut bars 40.

FIG. 3 illustrates a subassembly of the perimeter wall including anchor bolts 20 mounted within concrete inserts 30, which are in turn mounted or cast within floor support structure 2 of a building. The subassembly of FIG. 3 further includes anchor plate 10, which is adjustably mounted to anchor bolts 20 on the exterior side of floor support structure 2. In addition, the subassembly of FIG. 3 further includes serrated nut bars 40 with serrations 44 between heads 22 of anchor bolts 20 and anchor plate 10 as well as jamb nuts 35, which secure anchor plate 10 against serrated nut bars 40 and heads 22 of anchor bolts 20 and provide adjustment in and out of the vertical plane of the building envelope.

Inserts 30 are installed within floor support structure 2 of the building. Inserts 30 each include internal threads that adjustably receive one of anchor bolts 20 to attach the anchor bolt 20 to floor support structure 2.

Anchor bolts 20 are installed to extend outwardly from an exterior side of floor support structure 2. Anchor bolts 20 each include a bolt head 22 and a threaded shaft 24 suitable to adjustably mount the anchor bolt 20 on the exterior sides of the floor support structures of the building within a corresponding one of inserts 30.

Anchor plate 10 is secured to the exterior side of floor support structure 2 by anchor bolts 20 such that anchor bolts 20 are within oversize holes 18 of anchor plate 10. Anchor plate 10 includes a top mounting structure 12 and a bottom mounting structure 14 configured to receive spandrel unit 50 (as shown on FIG. 4 of sheet 1B). Anchor plate 10 further includes serrated surface 16 adjacent to oversize holes 18 on the exterior side of anchor bolts 20.

The subassembly of FIG. 3 further includes serrated nut bars 40 on anchor bolts 20 located between heads 22 of anchor bolts 20 and anchor plate 10. Serrated surface 44 of serrated nut bars 40 engage serrated surface 16 of anchor plate 10 in order to limit the motion (e.g. lock in the vertical position) of anchor plate 10 once anchor plate 10 is secured to anchor bolts 20. Jamb nuts 35 function to secure anchor plate 10 in place against heads 22 and provide up and down adjustment capabilities.

As mentioned previously, anchor plates 10 are secured to the exterior side of floor support structure 2 such that anchor bolts 20 are within oversize holes 18 of anchor plates 10. Oversize holes 18 facilitate installation of anchor plate 10 even with imperfect alignment between anchor bolts 20 and anchor plate 10. Anchor bolts 20 represent adjustable anchors and may provide six degree of freedom adjustability for anchor plate 10 in that each anchor bolt 20 may be extended or retracted relative to floor support structure 2. The length of anchor plate 10 provides side to side adjustment.

Oversize holes 18 further facilitate vertical adjustment and leveling of anchor plate 10 relative to the installed anchor bolts 20 to extend outwardly from the exterior side of floor support structure 2. For example, the precise position of an anchor bolt 20 within an oversize hole 18 of the anchor plate 10 may be adjusted to, for example, level anchor plate 10, align the anchor plate 10 with floor support structure 2, and adjust the position of anchor plate 10 relative to other anchor plates above mounted to other floor support structures above and below anchor plate 10.

Figure 4:
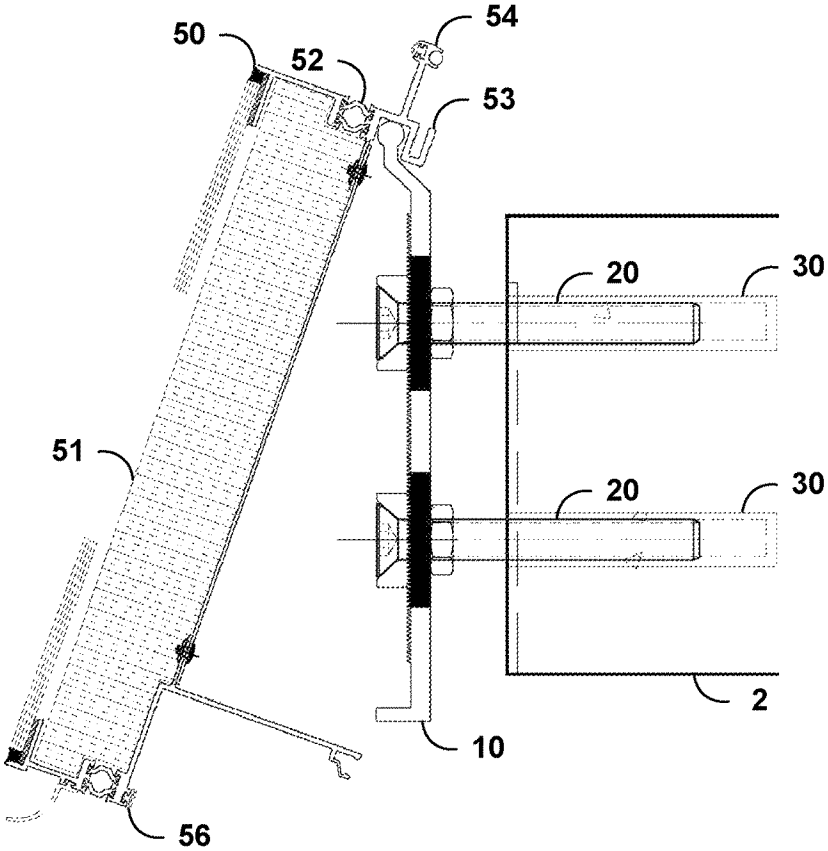
Figure 5B:
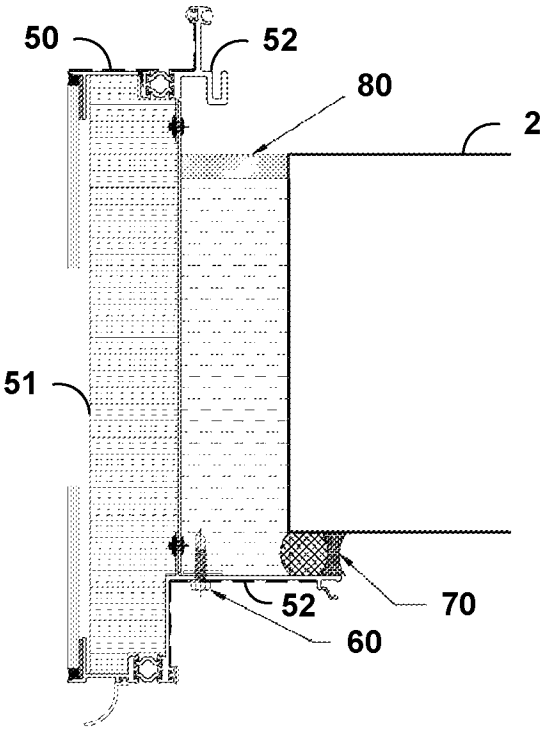
Figure 5A:
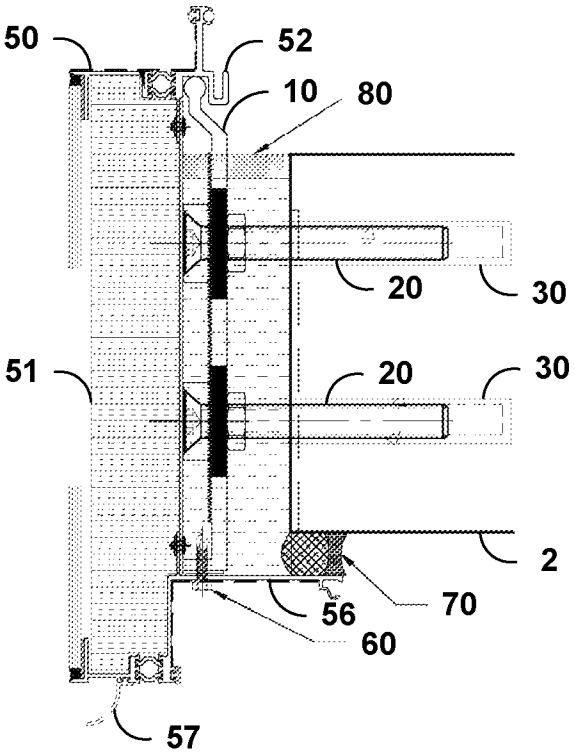

As shown on sheet 1B and sheet 1C, FIG. 4 and FIGS. 5A-5B illustrate spandrel unit 50 mounted to an exterior side of anchor plate 10 in the subassembly of FIG. 3. Specifically, FIG. 4 illustrates spandrel unit 50 being pivoted into position on an exterior side of anchor plate 10, whereas FIGS. 5A-5B illustrate spandrel unit 50 mounted to an exterior side of anchor plate 10. Spandrel unit 50 includes an upper mounting structure 52 and a lower mounting structure 56. Upper mounting structure 52 includes recess 53 configured to engage top mounting structure 12 of anchor plate 10 such that top mounting structure 12 of anchor plate 10 carries the dead weight and lateral load of spandrel unit 50. As shown in sheet 1D, upper mounting structure 52 further includes protrusion 54 configured to receive outer covering section 100A (FIG. 6) from above and to support the dead weight and lateral load of outer covering section 100A via anchor plate 10 and anchor bolts 20. Lower mounting structure 56 is configured to rotationally receive outer covering section 100B (FIG. 6) after dead weight of outer covering section 100B is loaded on an adjacent spandrel unit located below spandrel unit 50. Once spandrel unit 50 is rotated in place on anchor plate 10, locking screws 60 (FIGS. 5A and 5B) may be deployed to further secure spandrel unit 50 to anchor plate 10.

Spandrel unit 50 includes a facing material 51 that is visible from an exterior of the building once spandrel unit 50 is installed. Facing material 51 may include one or more of a single pane glass, a multi-pane glass, a polymer, a metal, a stone, a brick, and a concrete.

As best illustrated in FIGS. 5A and 5B, following the installation of spandrel unit 50 on anchor plate 10, an installer may install fire safing and smoke seal 80 in the space between anchor plate 10 and the exterior surface of floor support structure 2. This may limit the chimney effect for fire and smells between floors of the building. The installer my further install interior sealant 70 between lower mounting structure 56 and a bottom surface of floor support structure 2 as well as seal splice joints between adjacent sections of lower mounting structure 56.

Figure 6:
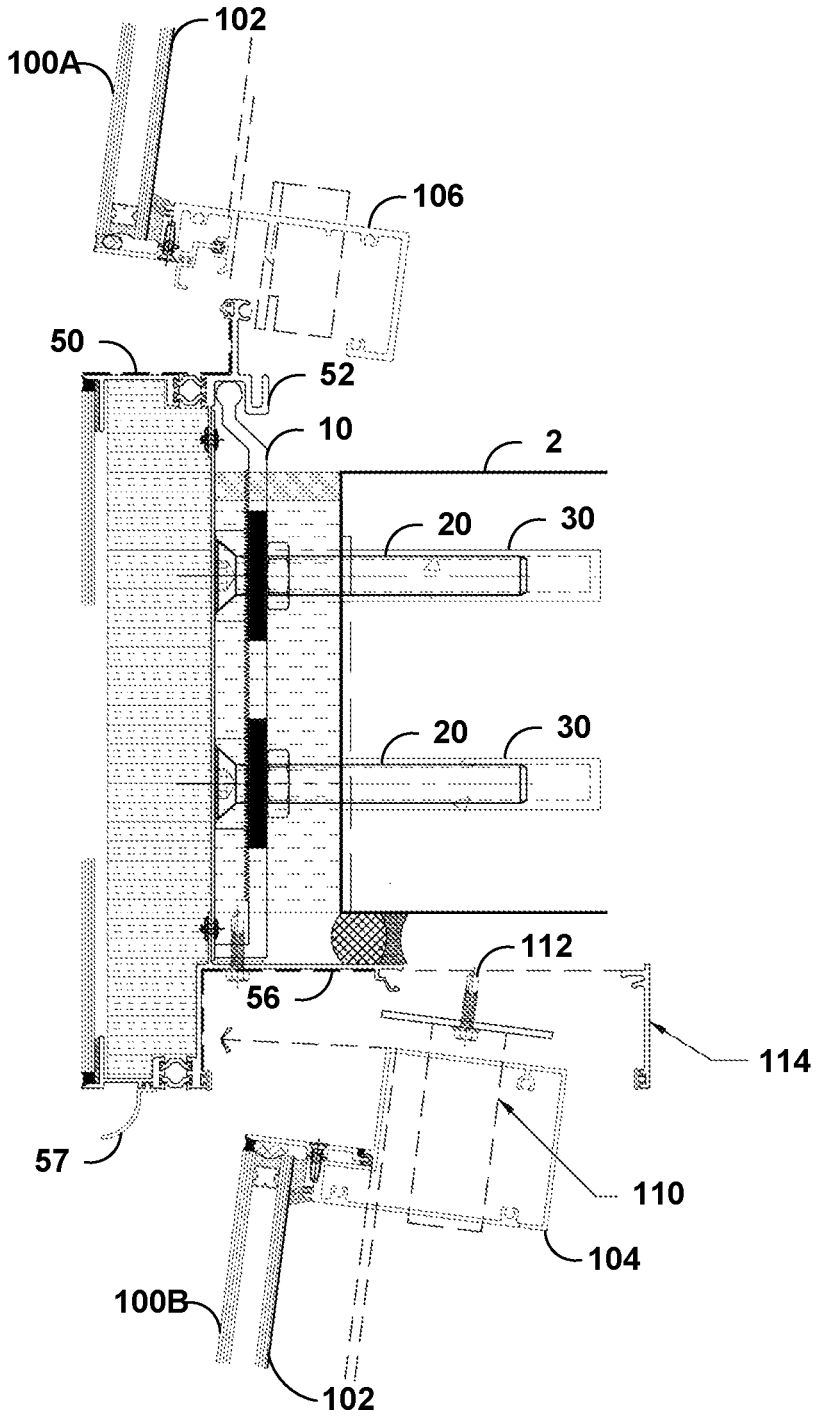

FIG. 6 illustrates a process for mounting outer covering sections 100A, 100B to the top and bottom, respectively, of anchor plate 10 in the subassembly of FIG. 3. Outer covering sections 100A, 100B each include upper frame member 104 and lower frame member 106 as well as outer covering material 102 spanning spaces between upper frame member 104 and lower frame member 106.

In different examples, outer covering material 102 may include one or more of a single pane glass, a multi-pane glass, a transparent polymer, a translucent polymer, an opaque polymer, a metal, a stone, a brick, and a concrete. Other suitable materials may also be used as the composition of outer covering material 102 is not germane to the disclosed perimeter walls techniques.

Outer covering sections 100A, 100B may be substantially similar to one another. In some examples, outer covering sections 100A, 100B may be preassembled with upper frame member 104 and lower frame member 106 and mullion components surrounding the outer covering material. For example, the mullion components between horizontally adjacent outer covering sections may combine to form a snap-fit mullion between the outer covering materials of the horizontally adjacent outer covering sections.

Upper mounting structure 52 of spandrel unit 50 is further configured to receive outer covering section 100A from above and to support the dead weight and lateral load of outer covering section 100A via anchor plate 10 and anchor bolts 20. Shear transfer lug 211 may be mechanically interlocked with vertical mullion extrusion 210 and may vertically slide to engage with a track in upper mounting structure 52 to provide additional lateral restraint for upper covering section 100A.

Lower mounting structure 56 of spandrel unit 50 is configured to rotationally receive outer covering section 100B after dead weight of outer covering section 100B is loaded on an adjacent spandrel unit located below spandrel unit 50.

As shown in FIG. 6, shear transfer lug 110 may be secured to lower mounting structure 56 of spandrel unit 50 by screw 112 once outer covering section 100B is rotated in place against lower mounting structure 56. Once installed, shear transfer lug 110 is operably coupled to lower mounting structure 56 of spandrel unit 50 and to vertical frame member 210 of outer covering section 100B to limit horizontal movement between spandrel unit 50 and the top of outer covering section 100B.

Lower mounting structure 56 provides an expansion joint between spandrel 50 and upper frame member 104 of outer covering section 100B. In some examples, the expansion joint may facilitate at least 0.25 inches, at least 0.50 inches or about 0.75 inches of movement between floor support structure 2 and another floor support structure used to mount outer covering section 100B. In particular, upper frame member 104 is configured to slide vertically along shear transfer lug 110 within the slot provided by lower mounting structure 56 of spandrel unit 50 and locking top clip 114. Lower mounting structure 56 optionally includes rain screen gasket 57 to mitigate water infiltration from the exterior of the assembled perimeter wall. This wall system may use pressure equalization principles to keep water out of the interior of the building.

Figure 7:
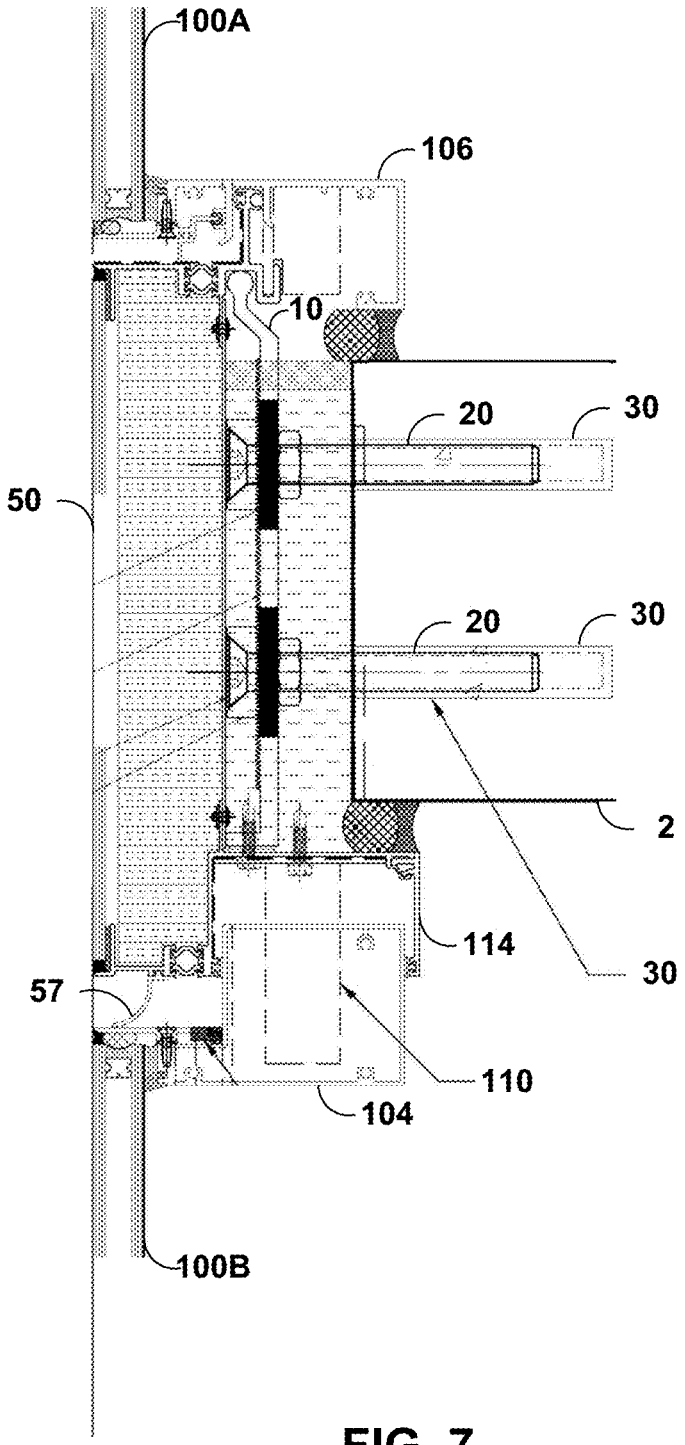
Figure 8:
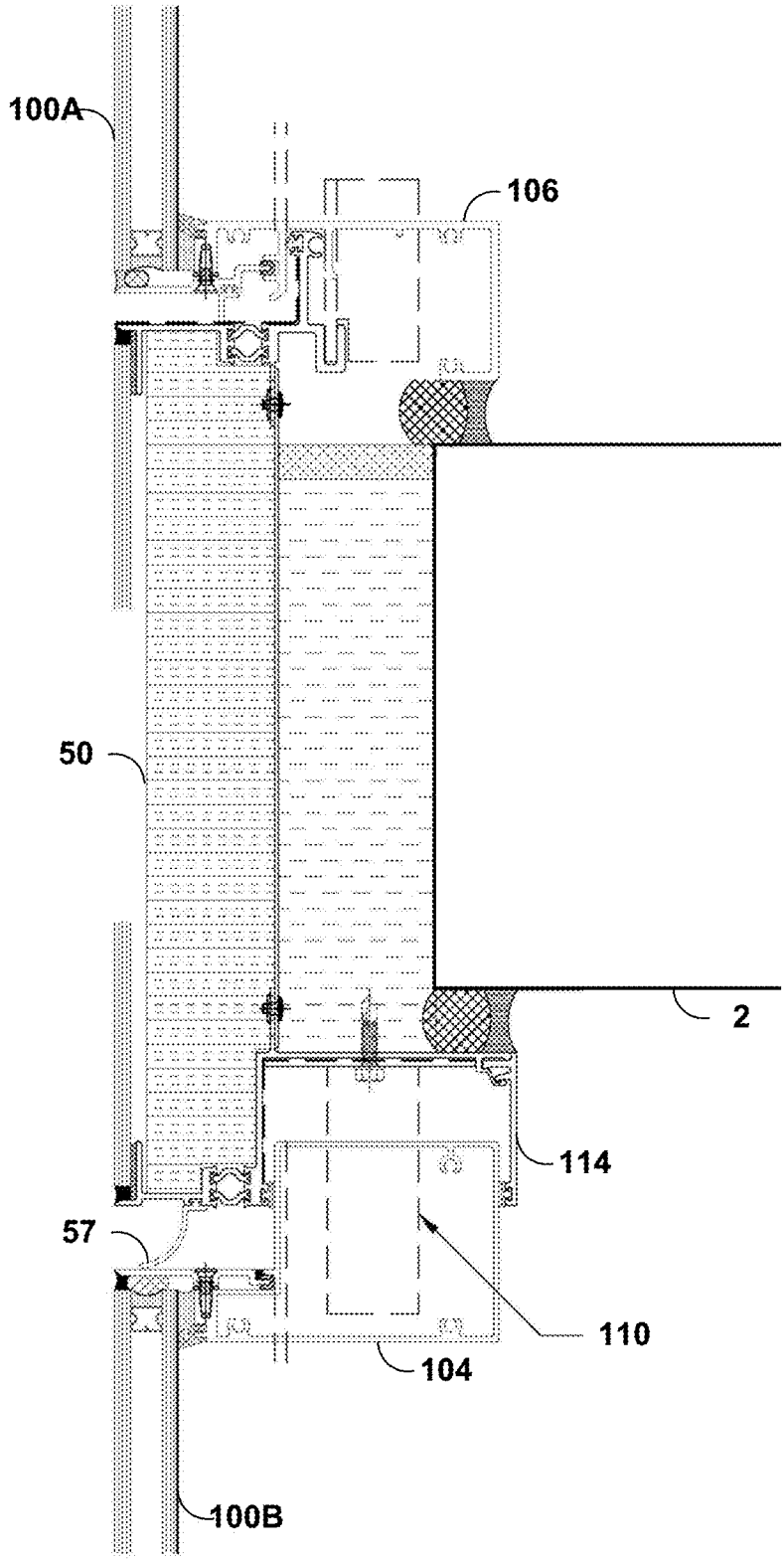

As shown on sheets 1E and 1F, FIGS. 7 and 8 illustrate an assembled perimeter wall at the floor support structure 2 visible in FIG. 3. As illustrated in FIGS. 7 and 8, outer covering sections 100A, 100B are located outside the perimeter of floor support structure 2.

Figure 9:
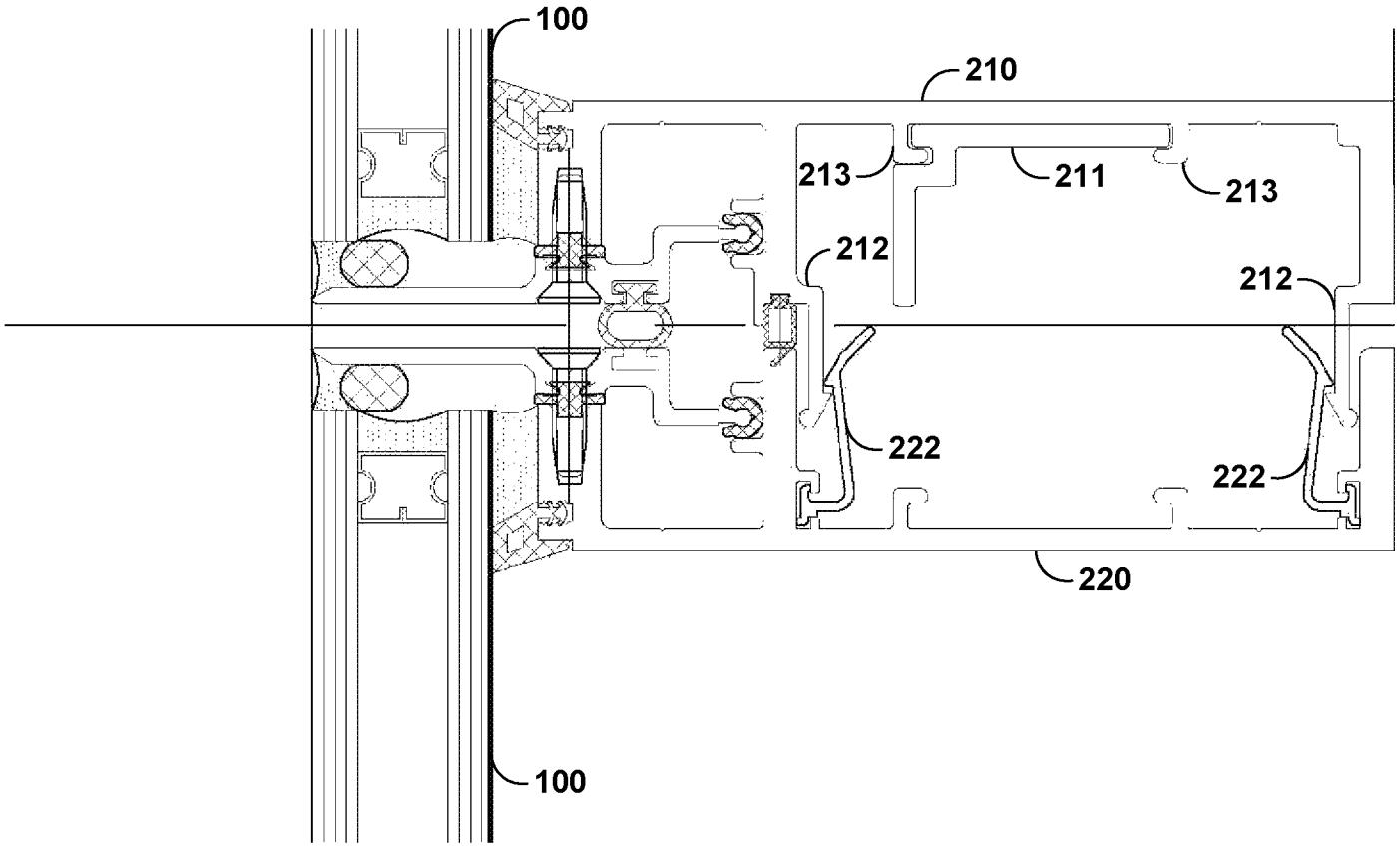
FIGS. 9-10 illustrate an example mullion suitable for use with the perimeter wall components illustrated FIGS. 1A-8.
Figure 10:
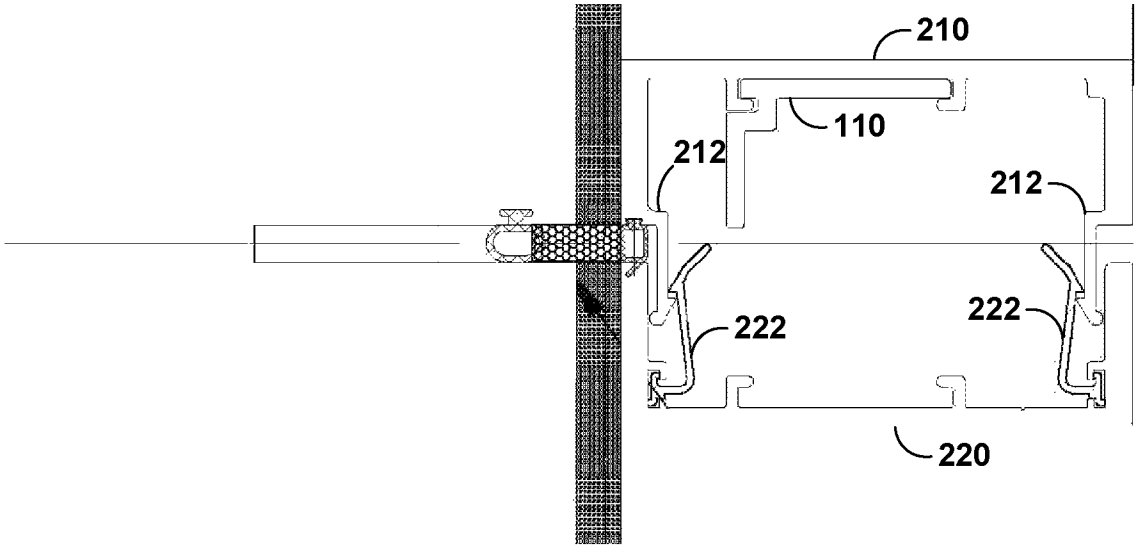

As shown on sheets 2A and 2B, FIGS. 9 and 10 illustrate an example mullion 200 suitable for use with the perimeter wall components illustrated FIGS. 1A-8. Mullion 200, as illustrated in FIGS. 9 and 10, may be positioned between horizontally adjacent outer covering sections and may extend between horizontal frame members of the plurality of outer covering sections, the horizontal frame members being configured to facilitate mounting of the outer covering sections to between two spandrel units 50, as discussed above with respect to FIGS. 1A-8.

Mullion 200 includes two mullion components 210, 220. For example, mullion components 210, 220 may be part of two horizontally adjacent outer covering sections. Mullion components 210, 220 combine to form a mullion 200 between the two horizontally adjacent outer covering sections. In particular, mullion components 210, 220 include snap-fit features 212, 222 that are snapped together to form mullion 200 between the two horizontally adjacent outer covering sections. Mullions 220 could be tubular and potentially eliminate the need for snap clip 222 in order to provide anti-buckling and better torsion properties to the mullion assembly. Mullion components 210, 211 may include a track 213 to mechanically engage the shear transfer lugs 110, 211.

As discussed above with respect to FIGS. 1A-8, such horizontally adjacent outer covering sections may be substantially similar to one another. For example, horizontally adjacent outer covering sections may be preassembled mullion components 210, 220 surrounding the outer covering material. Vertical mullion at spandrel 300 may include frame components 310 and 320, which may be used to form a union between two horizontally adjacent spandrel units 50. Air seal gasket 330 may be employed between frame components 310 and 320 to provide continuing of air seal vertically from upper mounting structure 52 to power mounting structure 56.

Figure 11:
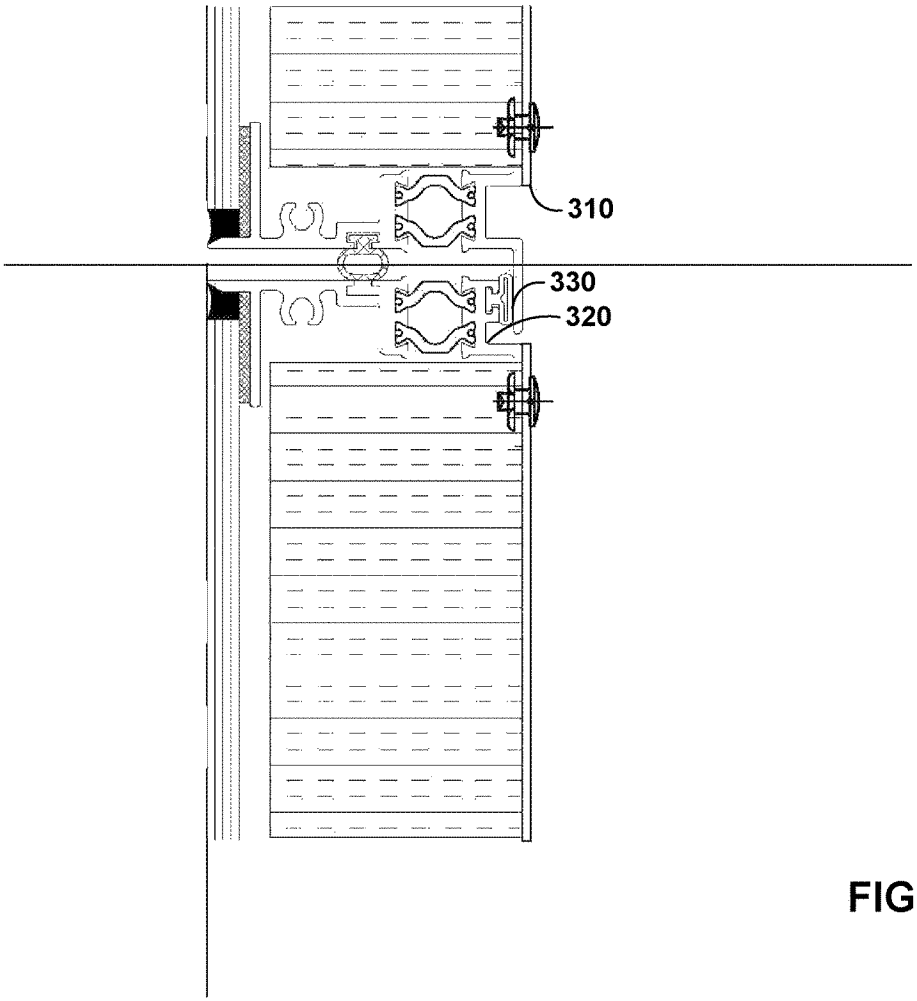
FIGS. 11-12 illustrate the example mullion of the spandrel of the perimeter wall illustrated FIGS. 1A-8.
Figure 12:
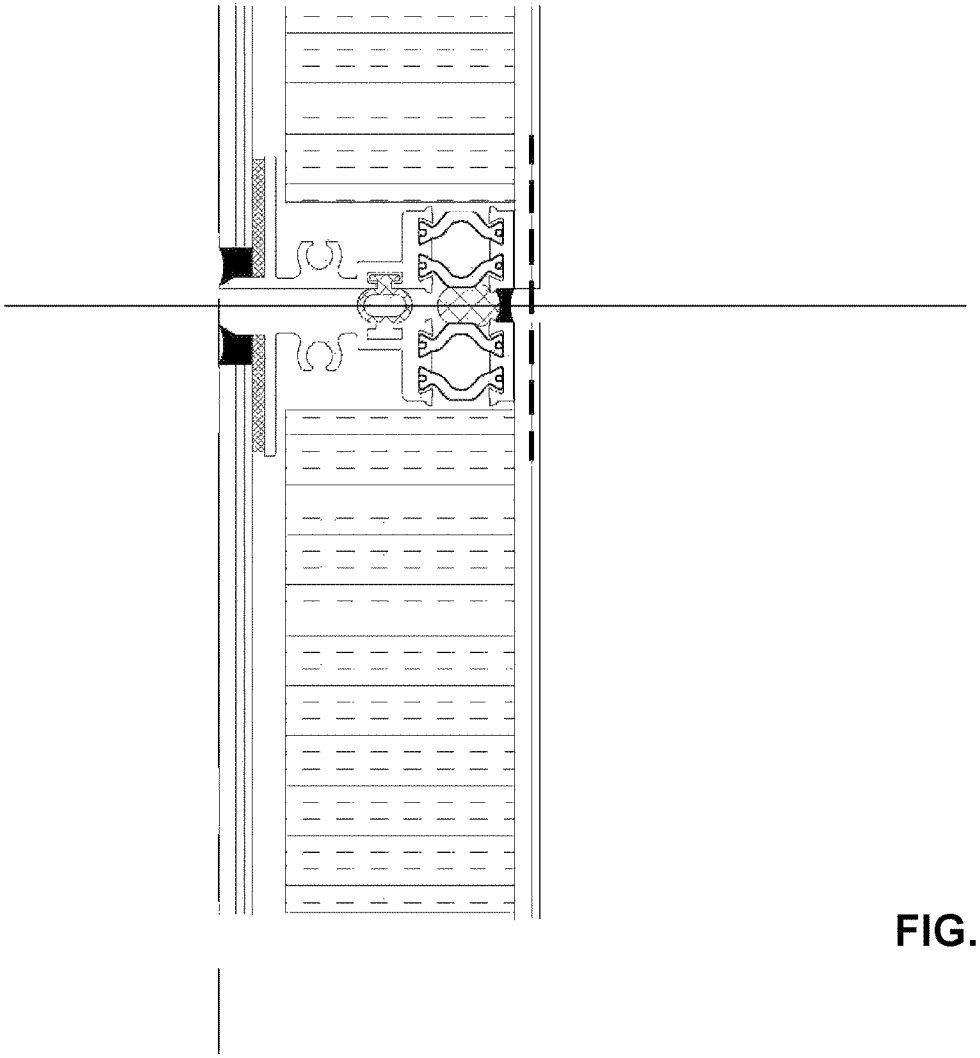

As shown on sheets 3A and 3B, FIGS. 11 and 12 illustrate the example mullion of FIGS. 9 and 10 in combination with the spandrel of the perimeter wall illustrated FIGS. 1A-8.

Figure 13:
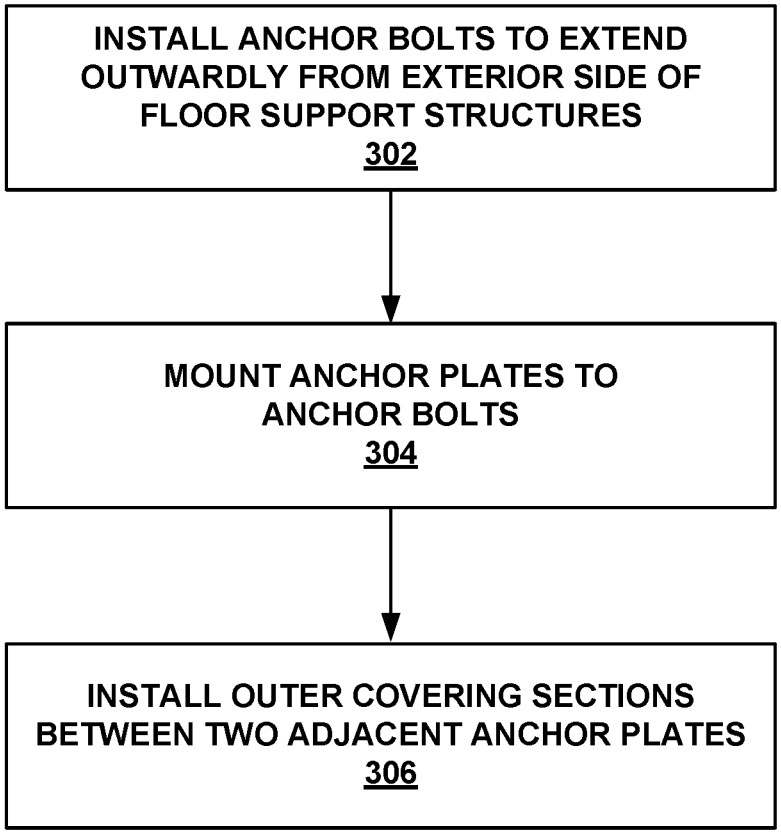
FIG. 13 is a flowchart illustrating an example method for installing a perimeter wall.

FIG. 13 is a flowchart illustrating an example method for installing a perimeter wall. First, at least one installer installs a plurality of anchor bolts, such as anchor bolts 20, to extend outwardly from an exterior side of the floor support structures, such as floor support structure 2, of the building (302). Then the installer mounts a plurality of anchor plates, such as anchor plate 10, to the plurality of anchor bolts on the exterior sides of the floor support structures of the building (304). Finally, the installer installs a plurality of outer covering sections, such as outer covering sections 100A, 100B, to the plurality of anchor plates such that each of the plurality of outer covering sections is located between two of the plurality of anchor plates, the two of the plurality of anchor plates being installed on two separate floor support structures of the building (306). The plurality of outer covering sections may be located outside the perimeter of the floor support structures supporting the two of the plurality of anchor plates once the outer covering sections are installed to the plurality of anchor plates.

In some examples, installing the plurality of outer covering sections to the plurality of anchor plates such that each of the plurality of outer covering sections is located between two of the plurality of anchor plates may include for each of the plurality of outer covering sections: positioning a bottom frame section of the frame sections on a lower one of the two of the plurality of anchor plates such that the lower anchor plate supports the dead weight of the first outer covering section via the associated anchor bolts, rotating the outer covering section until a top frame section of the frame sections to contact an upper one of the two of the plurality of anchor plates, and fastening the top frame section of the frame sections to the upper one of the two of the plurality of anchor plates in a manner that provides an expansion joint between the top frame section and the upper one of the two of the plurality of anchor plates.

Figures 14A, 14B, 15A, 15B, 16A, 16B, 17, 18:
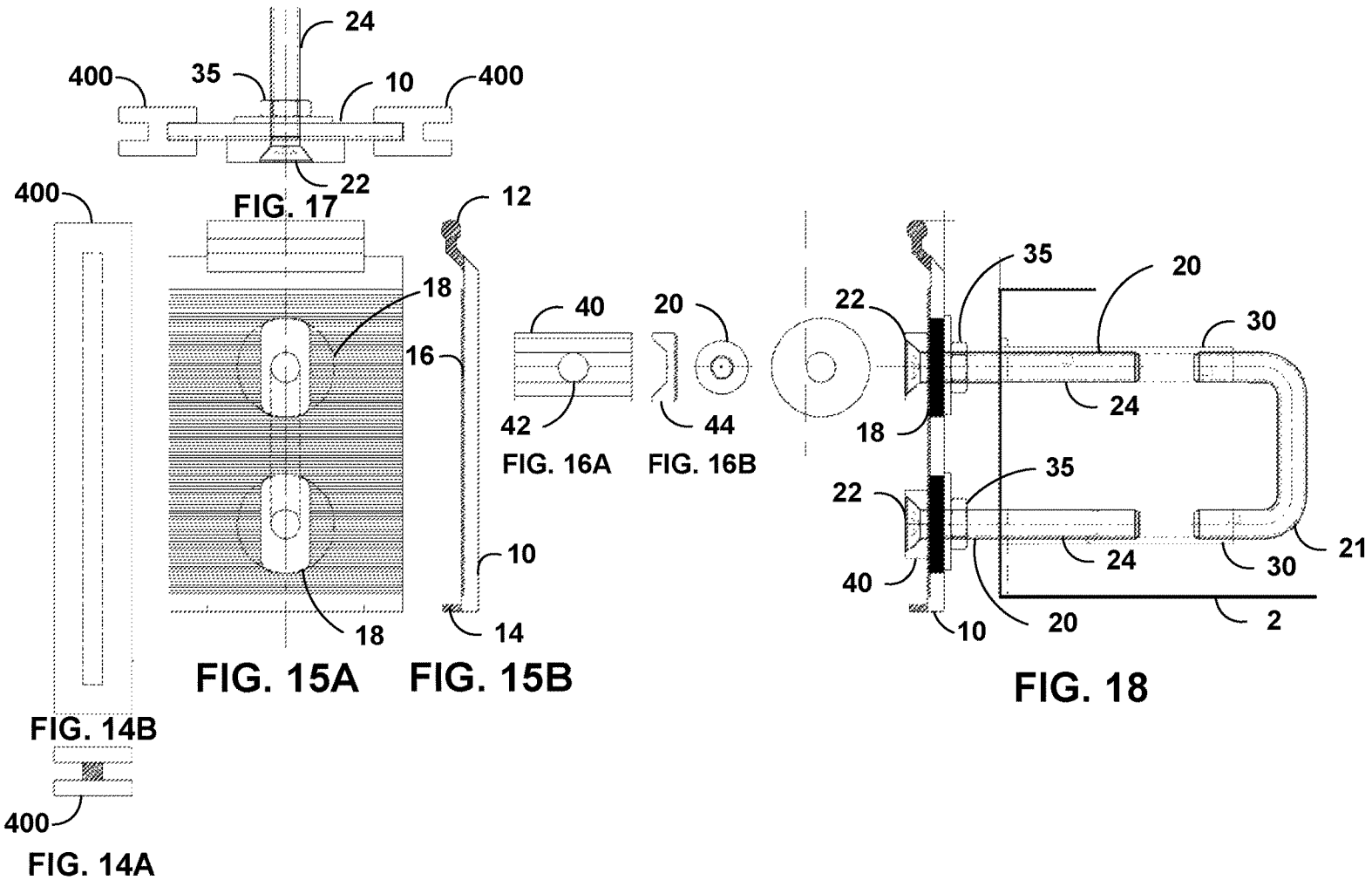

FIGS. 14A-20B illustrate components and an example installation procedure of a perimeter wall in accordance with one example of this disclosure. Sheet 5A includes FIGS. 14A-16. In particular, FIGS. 14A-14B illustrate slidable bracket 400, FIGS. 15A-15B illustrate anchor plate 10, FIGS. 16A-16B illustrate serrated nut bars 40, and FIG. 16 illustrates anchor plate 10 mounted to floor support structure 2 with anchor bolts 20 and serrated nut bars 40. The perimeter wall of FIGS. 14A-20B is similar to the perimeter wall of FIGS. 1A-8 with the addition of slidable brackets 400 between anchor plate 10 and spandrel unit 50. The design of the perimeter wall of FIGS. 14A-20B allows for a spandrel unit to extend beyond the height of the associated anchor plate, as shown with the spandrel unit of FIG. 21.

FIG. 18 illustrates a subassembly of the perimeter wall including anchor bolts 20 mounted within concrete inserts 30, which are in turn secured to U-bolt 21 and mounted or cast within floor support structure 2 of a building. The subassembly of FIG. 18 further includes anchor plate 10, which is adjustably mounted to anchor bolts 20 on the exterior side of floor support structure 2. In addition, the subassembly of FIG. 18 further includes serrated nut bars 40 between heads 22 of anchor bolts 20 and anchor plate 10 as well as jamb nuts 35, which secure anchor plate 10 against serrated nut bars 40 and heads 22 of anchor bolts 20 and provide adjustment in and out of the vertical plane of the building envelope.

Inserts 30 are installed within floor support structure 2 of the building. Inserts 30 each include internal threads that adjustably receive one of anchor bolts 20 to attach the anchor bolt 20 to floor support structure 2. U-bolt 21 is cast within floor support structure 2 and provides added support to concrete inserts 30.

Anchor bolts 20 are installed to extend outwardly from an exterior side of floor support structure 2. Anchor bolts 20 each include a bolt head 22 and a threaded shaft 24 suitable to adjustably mount the anchor bolt 20 on the exterior sides of the floor support structures of the building within a corresponding one of inserts 30.

Figure 19:
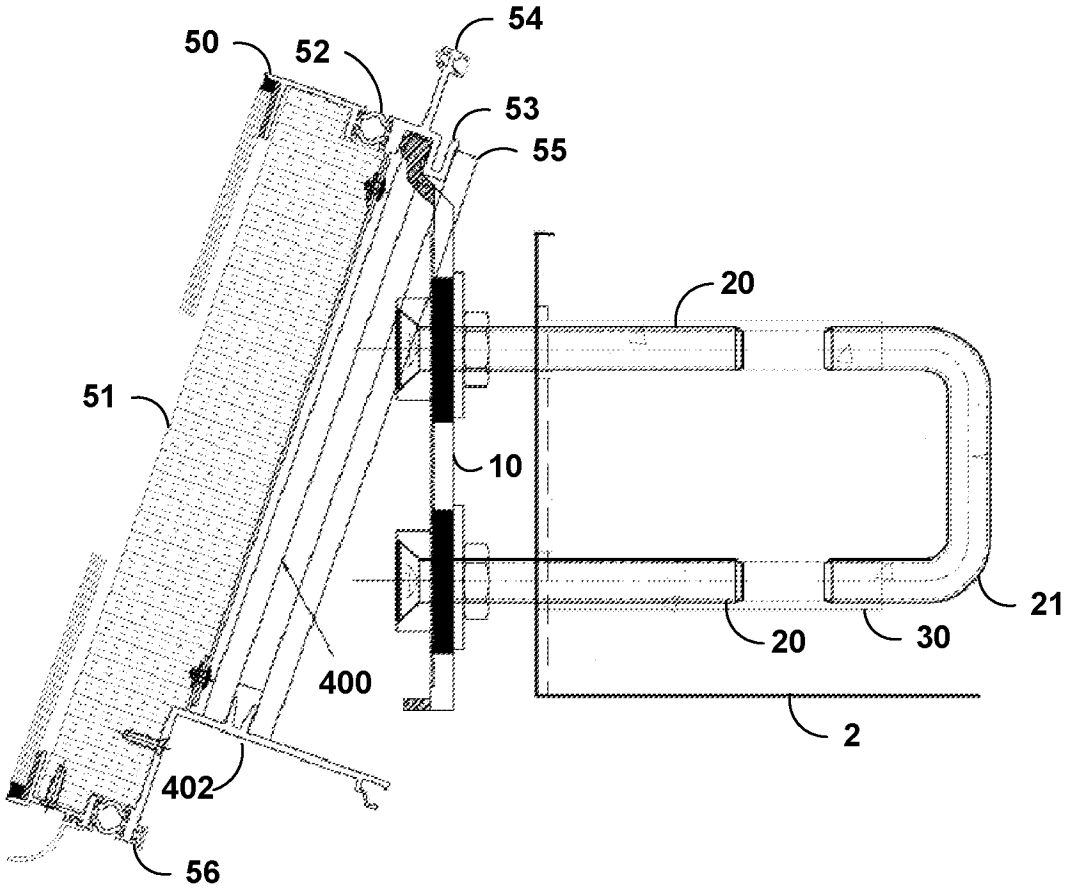

Anchor plate 10 is secured to the exterior side of floor support structure 2 by anchor bolts 20 such that anchor bolts 20 are within oversize holes 18 of anchor plate 10. Anchor plate 10 includes a top mounting structure 12 and a bottom mounting structure 14 configured to receive spandrel unit 50 (FIG. 19). Anchor plate 10 further includes serrated surface 16 adjacent to oversize holes 18 on the exterior side of anchor bolts 20.

The subassembly of FIG. 18 further includes serrated nut bars 40 on anchor bolts 20 located between heads 22 of anchor bolts 20 and anchor plate 10. Serrated nut bars 40 engage serrated surface 16 of anchor plate 10 in order to limit the motion (e.g. lock in the vertical position) of anchor plate 10 once anchor plate 10 is secured to anchor bolts 20. Jamb nuts 35 function to secure anchor plate 10 in place against heads 22 and provide up and down adjustment capabilities.

As mentioned previously, anchor plates 10 are secured to the exterior side of floor support structure 2 such that anchor bolts 20 are within oversize holes 18 of anchor plates 10. Oversize holes 18 facilitate installation of anchor plate 10 even with imperfect alignment between anchor bolts 20 and anchor plate 10. Anchor bolts 20 represent adjustable anchors and may provide six degree of freedom adjustability for anchor plate 10 in that each anchor bolt 20 may be extended or retracted relative to floor support structure 2. The length of anchor plate 10 provides side to side adjustment.

Oversize holes 18 further facilitate vertical adjustment and leveling of anchor plate 10 relative to the installed anchor bolts 20 to extend outwardly from the exterior side of floor support structure 2. For example, the precise position of an anchor bolt 20 within an oversize hole 18 of the anchor plate 10 may be adjusted to, for example, level anchor plate 10, align the anchor plate 10 with floor support structure 2, and adjust the position of anchor plate 10 relative to other anchor plates above mounted to other floor support structures above and below anchor plate 10.

As shown on sheet 5B and sheet 5C, FIGS. 19 and 20 illustrate spandrel unit 50 mounted to an exterior side of anchor plate 10 in the subassembly of FIG. 18. Spandrel unit 50 includes an upper mounting structure 52 and a lower mounting structure 56. In contrast to spandrel unit 50 of FIG. 4, spandrel unit 50 of FIGS. 19 and 20 further includes a set of slidable brackets 400 configured to engage either side of anchor plate 10 to secure spandrel unit 50 to anchor plate 10. In general, each spandrel unit 50 will mount to at least two anchor plates 10 and may mount to more than two anchor plates 10. For example, anchor plates 10 may be positioned at periodic intervals along the exterior surface of floor support structure 2 and the number of anchor plates a spandrel unit 50 mounts to may be dependent on the spacing of the anchor plates 10 and width of the spandrel unit 50. In general, a spandrel unit 50 will include two slidable brackets 400 for each associated anchor plate 10 used to mount the spandrel unit 50 to the exterior surface of floor support structure 2.

Upper mounting structure 52 includes recess 53 configured to engage top mounting structure 12 of anchor plate 10 such that top mounting structure 12 of anchor plate 10 carries the dead weight and lateral load of spandrel unit 50. Upper mounting structure 52 further includes protrusion 54 configured to receive outer covering section 100A (FIG. 21) from above and to support the dead weight and lateral load of outer covering section 100A via anchor plate 10 and anchor bolts 20. Lower mounting structure 56 is configured to rotationally receive outer covering section 100B (FIG. 21) after dead weight of outer covering section 100B is loaded on an adjacent spandrel unit located below spandrel unit 50. Once spandrel unit 50 is rotated in place on anchor plate 10, slidable brackets 400 may be slid into place along channel 402 and 55 (FIG. 19) of spandrel unit to further secure spandrel unit 50 to anchor plate 10. Slidable brackets 400 may be secured in place using set spring 401 (FIG. 5C).

Spandrel unit 50 includes a facing material 51 that is visible from an exterior of the building once spandrel unit 50 is installed. Facing material 51 may include one or more of a single pane glass, a multi-pane glass, a polymer, a metal, a stone, a brick, and a concrete.

Figure 20B:
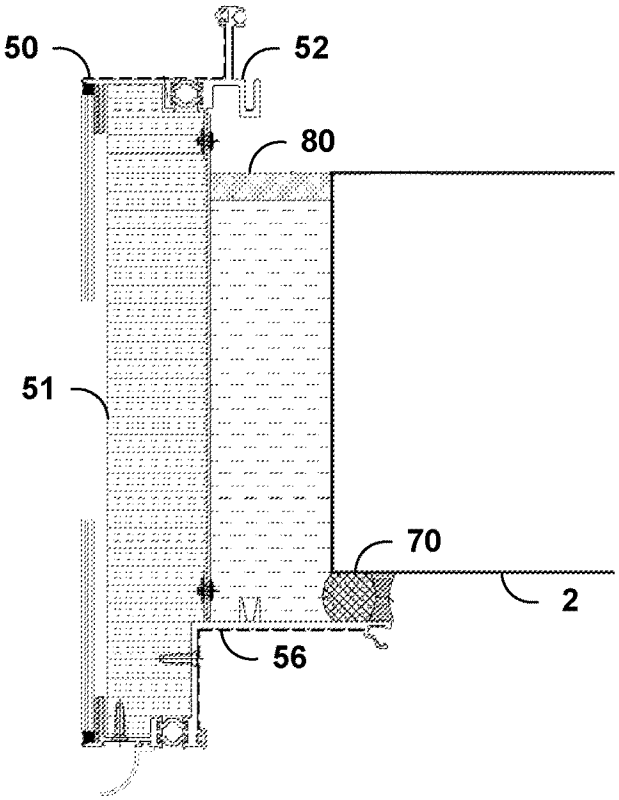
Figure 20A:
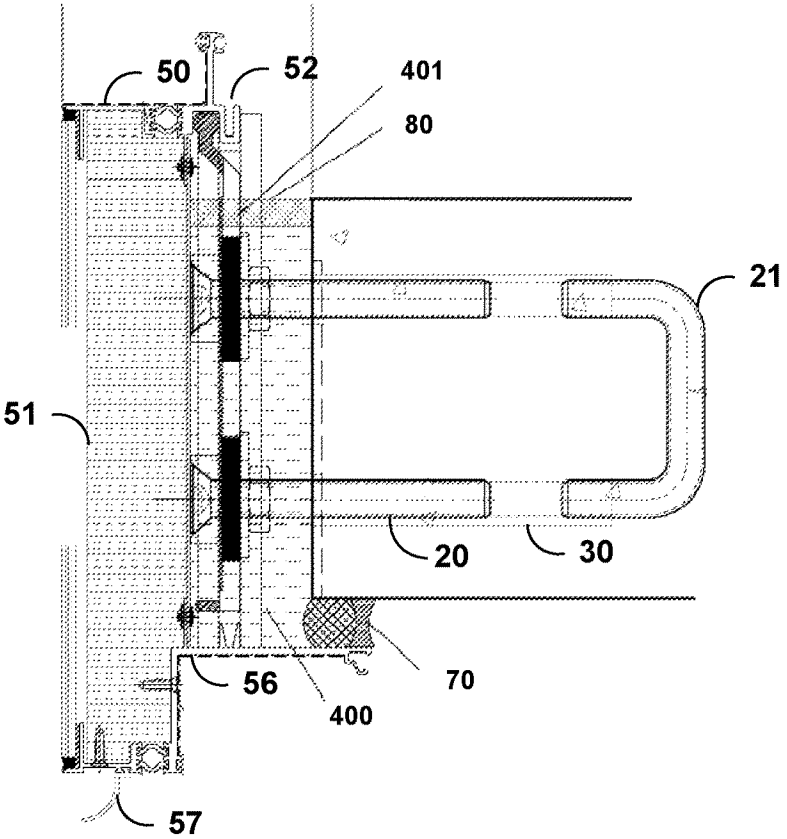

As best illustrated in FIGS. 20A and 20B, following the installation of spandrel unit 50 on anchor plate 10, an installer may install fire safing and smoke seal 80 in the space between anchor plate 10 and the exterior surface of floor support structure 2. This may limit the chimney effect for fire and smells between floors of the building. The installer my further install interior sealant 70 between lower mounting structure 56 and a bottom surface of floor support structure 2 as well as seal splice joints between adjacent sections of lower mounting structure 56. The process for mounting outer covering sections 100A, 100B to the top and bottom, respectively, of anchor plate 10 in the subassembly of FIG. 18 is similar to that illustrated with respect to FIG. 6, and, for brevity is not repeated here.

Figure 21:
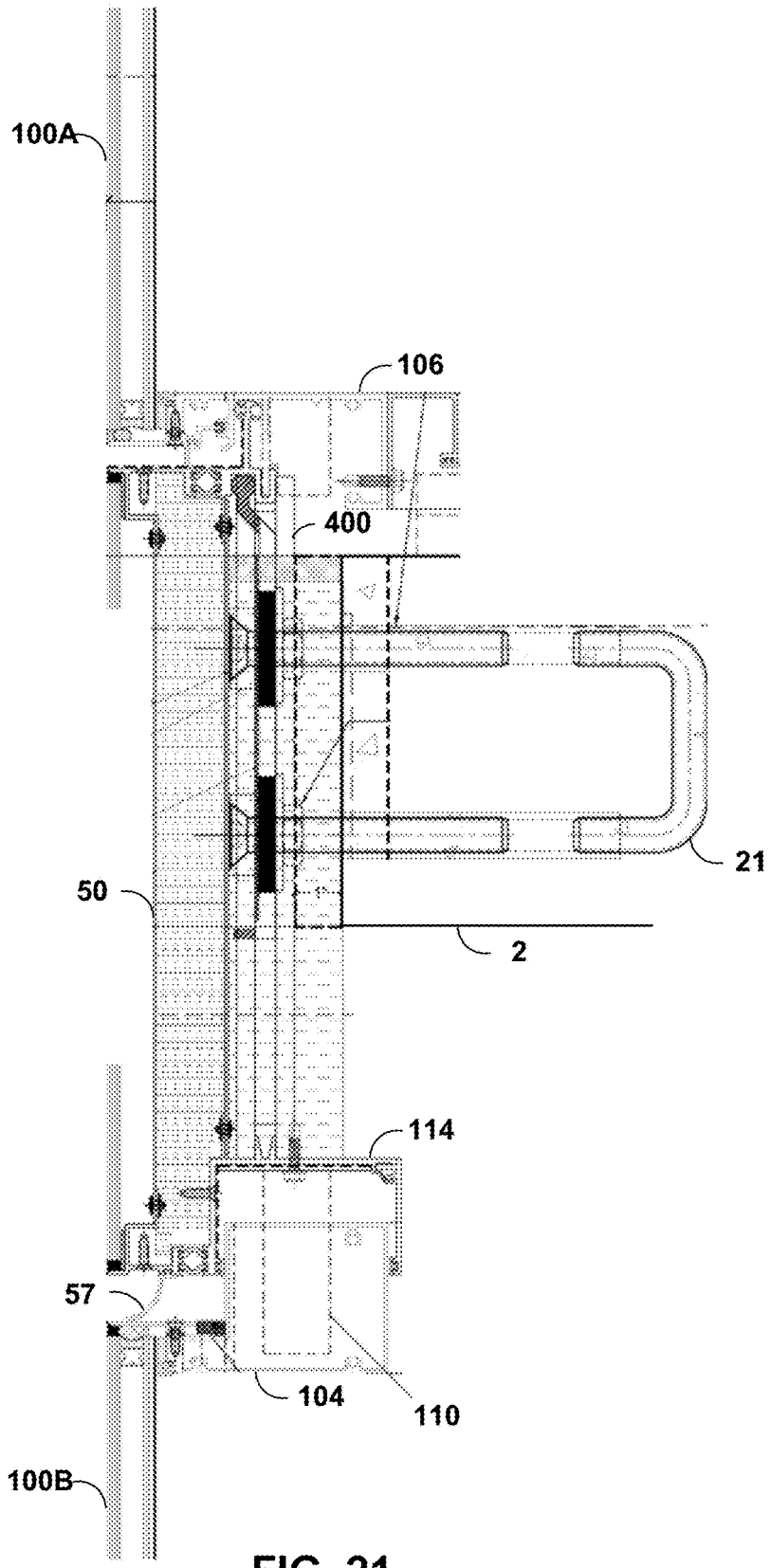
FIG. 21 illustrates an example anchor plate and spandrel unit assembly in which the spandrel unit extends beyond the height of the anchor plate.

FIG. 21 illustrates an assembled perimeter wall at the floor support structure 2 visible in FIG. 18. As illustrated in FIG. 21, outer covering sections 100A, 100B are located outside the perimeter of floor support structure 2.

Figure 22:
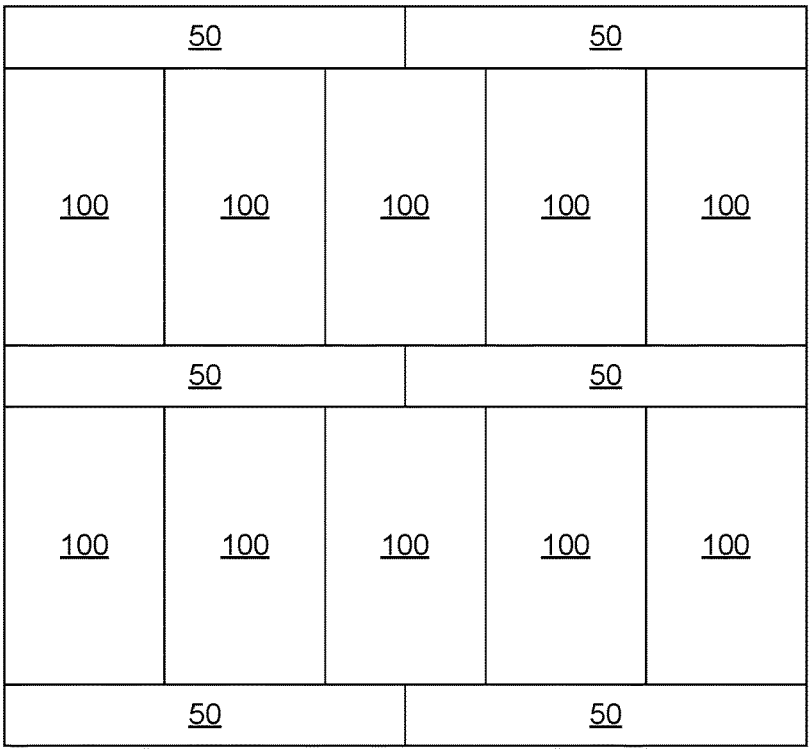
FIGS. 22 and 23 illustrate example perimeter walls with multiple outer covering sections for each spandrel unit section.
Figure 23:
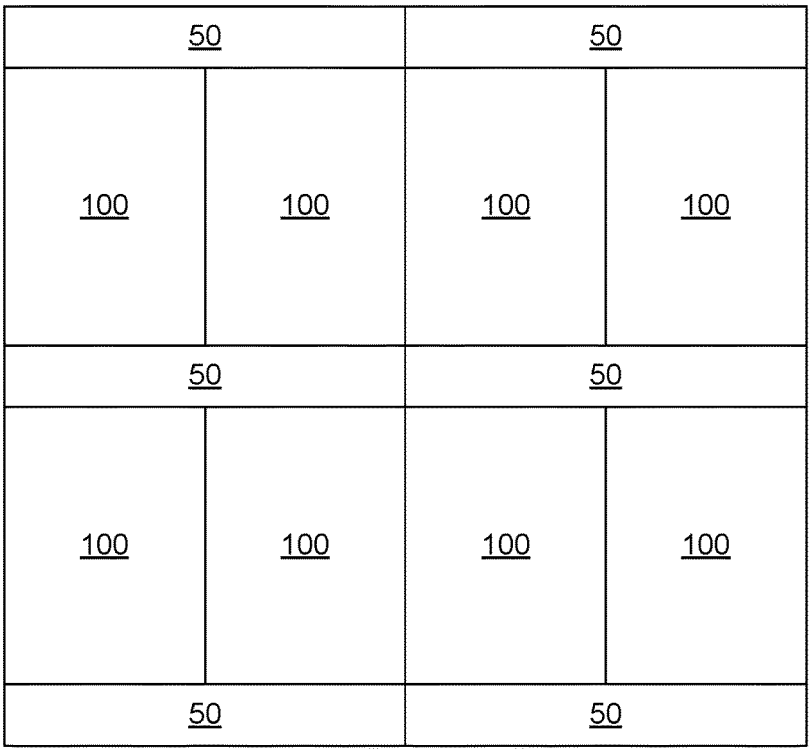

FIGS. 22 and 23 illustrate example perimeter walls with multiple outer covering sections for each spandrel unit 50. In particular, due to the common horizontal profile of spandrel units 50 at the interface with outer covering sections 100, a section of perimeter wall may include more or outer covering sections 100 for each spandrel unit 50. In the example of FIG. 22, the perimeter wall includes five outer covering sections 100 for every two spandrel units 50. In the example of FIG. 23, the perimeter wall includes two outer covering sections 100 for every one of spandrel units 50. Any number of various configurations is possible including more spandrel units 50 than outer covering sections 100, and spandrel units 50 and/or outer covering sections 100 of varying widths. In this manner, any number of patterns and designs for a perimeter wall may be implemented using the techniques disclosed herein.

Various examples and techniques have been described. Aspects or features of examples described herein may be combined with any other aspect or feature described in another example. These described examples and other examples are within the scope of the following claims.

What is claimed is:

1. A perimeter wall for a building comprising:

a plurality of anchor bolts extending outwardly from an exterior side of floor support structures of the building;

a plurality of anchor plates adjustably mounted to the plurality of anchor bolts on the exterior side of the floor support structures of the building; and a plurality of outer covering sections including a first outer covering section and a second outer covering section;

a plurality of spandrel units, wherein each spandrel unit of the plurality of spandrel units is mounted to an exterior side of a respective anchor plate of the plurality of anchor plates, wherein each spandrel unit of the plurality of spandrel units includes:

a first mounting structure on an upper portion of a respective spandrel unit, wherein the first mounting structure is configured to receive the first outer covering section from above and to support a dead weight and lateral load of the first outer covering section via a corresponding one of the plurality of anchor plates and associated anchor bolts, wherein the first outer covering section is supported by the first mounting structure; and a second mounting structure on a lower portion of the respective spandrel unit, wherein the second mounting structure is configured to rotationally receive, on an interior side of a respective spandrel unit, the second outer covering section after dead weight of the second outer covering section is loaded on an adjacent spandrel unit located below that one of the plurality of spandrel units, wherein the second mounting structure includes a locking clip on the interior side of the respective spandrel unit, wherein the locking clip is configured to hold the second outer covering section in place.

2. The perimeter wall of claim 1, wherein the second mounting structure includes an expansion joint that facilitates at least 0.25 inches of movement between two floor support structures used to mount a single outer covering section of the plurality of outer covering sections.

3. The perimeter wall of claim 1, further comprising at least one shear transfer lug operably coupled to the second mounting structure and to the second outer covering section to limit horizontal movement between the second mounting structure and the top of the second outer covering section.

4. The perimeter wall of claim 1, wherein the plurality of spandrel units includes at least one material visible from an exterior of the building once the plurality of spandrel units are installed, wherein the at least one material is selected from a group consisting of:

a single pane glass;
a multi-pane glass;
a polymer;
a metal;
a stone;
a brick;
a concrete;
a terracotta; and
a louver.

5. The perimeter wall of claim 1, wherein the plurality of outer covering sections includes:

frame members mounted between two anchor plates of the plurality of anchor plates, the two anchor plates of the plurality of anchor plates being installed on two separate floor support structures of the building; and outer covering material spanning spaces between the frame members, wherein each outer covering section of the plurality of outer covering sections is located outside the perimeter of the floor support structures supporting the two anchor plates of the plurality of anchor plates.

6. The perimeter wall of claim 5, wherein each outer covering section of the plurality of outer covering sections is oriented such that the frame members extend in a generally horizontal direction.

7. The perimeter wall of claim 5, further comprising a plurality of mullions positioned between horizontally adjacent outer covering sections of the plurality of outer covering sections, such that each of the plurality of mullions extend between the frame members of the plurality of outer covering sections.

8. The perimeter wall of claim 7, wherein each outer covering section of the plurality of outer covering sections is preassembled with the frame members and mullion components surrounding the outer covering material.

9. The perimeter wall of claim 8, wherein the mullion components of two horizontally adjacent outer covering sections are combined to form a first mullion of the plurality of mullions located between the two horizontally adjacent outer covering sections.

10. The perimeter wall of claim 9, wherein the mullion components of two horizontally adjacent outer covering sections are snapped configured to snap together to the first mullion of the plurality of mullions located between the two horizontally adjacent outer covering sections.

11. The perimeter wall of claim 5, wherein the outer covering material includes at least one material selected from a group consisting of:

a single pane glass;
a multi-pane glass;
a polymer;
a metal;
a stone;
a brick;
a concrete;
a terracotta;
a louver;
an operable vent; and
a door.

12. The perimeter wall of claim 1, wherein each anchor plate of the plurality of anchor plates includes one or more oversize holes configured to fit over the plurality of anchor bolts, wherein the oversize holes facilitate installation of the plurality of anchor plates even with imperfect alignment between the plurality of anchor bolts, and wherein the oversize holes further facilitate vertical adjustment and leveling of the plurality of anchor plates relative to the installed anchor bolts to extend outwardly from the exterior side of the floor support structures of the building.

13. The perimeter wall of claim 12, wherein each anchor plate of the plurality of anchor plates includes serrated surfaces adjacent to the oversize holes on the exterior sides of the plurality of anchor plates, and wherein the perimeter wall further comprises a plurality of serrated nut bars on the plurality of anchor bolts, wherein the serrated nut bars are configured to engage the serrated surfaces adjacent to the oversize holes on the exterior sides of the plurality of anchor plates in order to limit the motion of the plurality of anchor plates once the plurality of anchor plates are secured to the plurality of anchor bolts.

14. The perimeter wall of claim 1, further comprising a plurality of jamb nuts and washers securing the plurality of anchor plates in place to the ends of the plurality of anchor bolts once the plurality of anchor bolts are properly positioned relative to the floor support structures of the building.

15. The perimeter wall of claim 1, further comprising a plurality of inserts installed within the floor support structures of the building, wherein the inserts include internal threads and are configured to adjustably receive the plurality of anchor bolts to attach the plurality of anchor bolts to the floor support structures of the building.

16. The perimeter wall of claim 1, wherein each of the plurality of spandrel units includes a set of slidable brackets to engage associated anchor plates to secure the spandrel unit to the associated anchor plates.

17. The perimeter wall of claim 1, wherein each anchor plate of the plurality of anchor plates includes a third mounting structure; and wherein the first mounting structure of each spandrel unit of the plurality of spandrel units is configured to engage the third mounting structure of each respective anchor plate such that the third mounting structure carries dead weight and lateral load of a respective spandrel unit.

18. The perimeter wall of claim 17, wherein each spandrel unit of the plurality of spandrel units includes a set of slidable brackets configured to engage each associated anchor plate to secure each spandrel unit to each associated anchor plate.

19. The perimeter wall of claim 1, wherein the second mounting structure includes a flange extending to the interior side of the respective spandrel unit, and wherein the flange is coupled to the locking clip and to an upper frame member of the second outer covering section.

20. The perimeter wall of claim 1, wherein the second mounting structure includes a rain screen gasket extending towards the second outer covering section to mitigate water infiltration from an exterior side of the perimeter wall.

* * * * *